United States Patent [19]

Moritz et al.

[11] Patent Number: 4,471,335

[45] **Date of Patent: * Sep. 11, 1984**

[54] TRANSFORMER OR REACTOR HAVING A WINDING FORMED FROM SHEET MATERIAL

[75] Inventors: Bertil Moritz; Ole Tönnesen, both of Västerås, Sweden

[73] Assignee: Asea AB, Västerås, Sweden

[ * ] Notice: The portion of the term of this patent subsequent to Apr. 6, 1999 has been disclaimed.

[21] Appl. No.: 354,391

[22] Filed: Mar. 3, 1982

Related U.S. Application Data

[63] Continuation of Ser. No. 176,918, Aug. 11, 1980, Pat. No. 4,323,870.

[30] Foreign Application Priority Data

Aug. 14, 1979 [SE] Sweden ..... 7906766

[51] Int. Cl.[3] ..... H01F 27/28

[52] U.S. Cl. ..... 336/206; 336/60; 336/223

[58] Field of Search ..... 336/222, 223, 225, 228, 336/231, 232, 206, 60

[56] References Cited

U.S. PATENT DOCUMENTS

| | | | |
|---|---|---|---|
| 1,331,077 | 2/1920 | Moody | 336/223 X |
| 1,825,105 | 9/1931 | Terman | 336/223 X |
| 3,464,043 | 8/1969 | Benko et al. | 336/223 X |
| 3,634,800 | 1/1972 | Fisher | 336/223 X |
| 3,691,498 | 9/1972 | Zwelling et al. | 336/206 X |
| 3,928,832 | 12/1975 | Forsberg et al. | 336/223 X |
| 4,259,654 | 3/1981 | Persson et al. | 336/223 |

FOREIGN PATENT DOCUMENTS

| | | | |
|---|---|---|---|
| 415958 | 7/1925 | Fed. Rep. of Germany | 336/223 |
| 1411081 | 9/1965 | France | 336/222 |

*Primary Examiner*—Thomas J. Kozma

*Attorney, Agent, or Firm*—Watson, Cole, Grindle & Watson

[57] ABSTRACT

To reduce the ohmic losses in a sheet-wound transformer or reactor winding, edge regions of at least some of the turns of the conductor sheet forming the winding are located at a different distance from the geometric axis of the winding compared with the distance from said axis of a central conductor portion in a respective one of said turns. Preferably the conductor sheet in each turn substantially follows the flux lines for the resultant magnetic leakage flux which corresponds to a constant current density in the sheet. For example, the winding may be wound from a metallic foil whose edge regions are folded back on themselves, or end regions of the winding may be provided with inter-turn packings (e.g. of tape) to achieve the desired flared shape of the turns at the ends of the winding.

9 Claims, 7 Drawing Figures

TRANSFORMER OR REACTOR HAVING A WINDING FORMED FROM SHEET MATERIAL

This is a continuation of application Ser. No. 176,918, filed Aug. 11, 1980, and now U.S. Pat. No. 4,323,870, issued Apr. 6, 1982.

TECHNICAL FIELD

The present invention relates to a transformer or a reactor comprising a core of magnetic material with at least one leg and yokes and at least one winding of a sheet-formed conductor material, arranged substantially concentrically around the core leg.

In power transformers and reactors having windings formed from electrically conducting sheet material, a considerable concentration of the current may occur towards the edges of the turns, resulting in a significant additional power loss as well as in considerable localized heating of the sheet at the edges of the turns. A displacement of the current flow in the turns is caused by the substantially axial magnetic leakage flux passing between the winding and the core being deflected in a generally radial direction at the inside and outside of the winding, which leakage flux passes into the core leg or completes its path outside the core instead of continuing axially and passing into the yokes. Because of this effect, the edges of the innermost and outermost of the winding turns will be subjected to a magnetic flux with a radial component which generates eddy currents in edge regions of the winding turns and causes losses in addition to the unavoidable ohmic losses caused by the load current. These eddy current losses raise the temperature in regions of the winding so that these regions may assume unacceptably high local values.

BACKGROUND ART

Several different measures have been proposed for straightening up the leakage flux, for example by locating, adjacent to the windings, bodies of high permeability, wire-wound coils traversed by the winding current, or shields of electrically conducting material (see, e.g. U.S. Pat. Nos. 3,142,029 and 4,012,706). However, these measures only result in a limited reduction of the edge current density.

DISCLOSURE OF INVENTION

The present invention seeks to provide a better solution to the above-mentioned problem of current maldistribution than what has previously been proposed.

According to the invention a transformer or reactor comprising a core of magnetic material with at least one leg and one yoke and at least one winding of sheet-formed conductor material arranged substantially concentrically around the core leg, is characterized in that the edge regions of at least some of the turns of the winding are located at a different distance from the geometrical axis of the winding compared with the distance from said axis of a central conductor portion in a respective one of said turns.

The basic idea behind the invention is that, instead of trying to influence the field, the conductor material is shaped to follow the field, that is, the sheet or the foil is formed in such a way that the field vector at each point at least approximates to a tangent to the conductor surface. In this way the current constriction in the turns can be considerably reduced.

The winding of a transformer or reactor according to the invention normally has a funnel-shaped deflection in the edge regions of at least some of its turns. This deflection may be provided in each such turn by forming the winding from a metallic foil in which the edges of the foil are bent back on themselves (i.e. folded through 180°). Such folded edges also give rise to advantages in the form of a reduced risk of corona at the axial ends of the winding, an increased conductor cross-section in the edge regions of the said turns, and thus an improved fill factor, as well as a more rigid construction for the completed winding. In addition, the possible harmful effect of burrs arising on the cutting of the foil is eliminated.

The funnel-shaped deflection may also be achieved by inserting separate strips between turns along the axial ends of the winding. These strips may be made from electrically conducting and/or from electrically insulating material. The cross-section of the strips may be wedge-shaped.

It is possible to form the axial end portions of a winding support body (e.g. a supporting cylinder and/or spacer bars) in such a way that the cross-section of the innermost turn of the winding resting on the support body acquires a double-curved shape. In this way the need to use inter-turn strips may be restricted to an end zone of the winding of a width of only a few millimeters. Since the penetration of the inter-turn strips between the winding turns is relatively small, it is possible in this case, without significantly affecting the thermal conduction in the winding, to use strips of electrically insulating material, which is advantageous for, among other things, dielectric reasons. The strips are suitably made in the form of a self-adhesive tape, whereby the strips are not displaced with respect to the sheet edges during the winding operation. The desired shape of the end regions of the winding turns may be obtained, for example, by using tapes of different thicknesses or a tape of constant thickness, and, in the latter case, the number of tape layers between adjacent winding turns in different places can be varied in a predetermined manner.

BRIEF DESCRIPTION OF DRAWINGS

The invention will now be described, by way of example, in greater detail with reference to a number of embodiments disclosed in the accompanying drawings, wherein.

DESCRIPTION OF PREFERRED EMBODIMENTS

Figure 1:
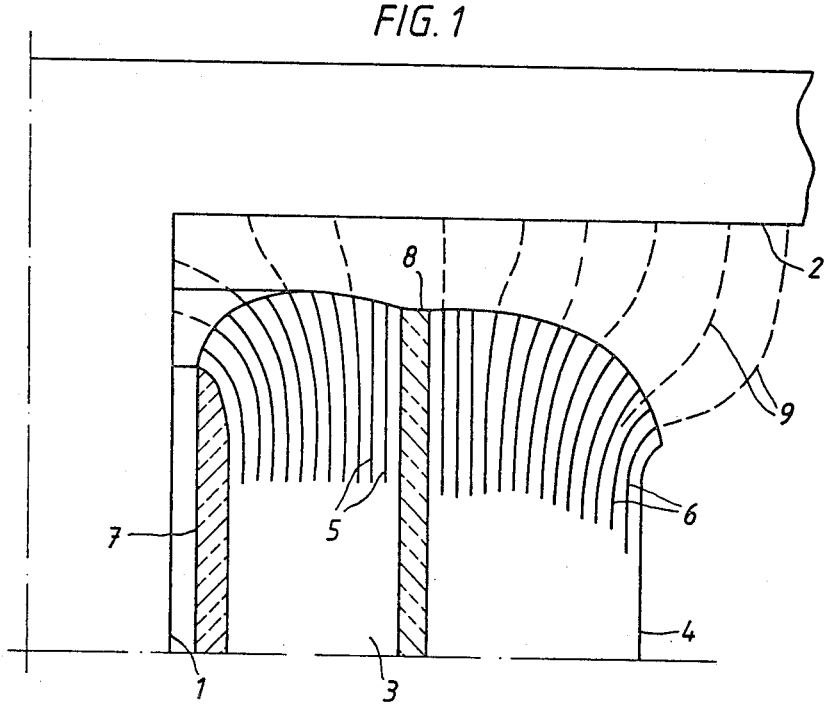
FIG. 1 shows schematically, for illustration of the principle of the invention, a section through the upper portion of two foil windings arranged around a core leg.

FIG. 1 shows part of a transformer core with a core leg 1 and yoke 2 of a power transformer. Arranged concentrically around the core leg 1 are an inner winding 3 and an outer winding 4. The windings are built up from turns 5 and 6, respectively, of aluminum or copper foil, the thickness of which foil is between 0.01 and 3 mm, preferably between 0.02 and 1 mm. Between the winding turns 5 and 6 there is a film of a suitable electrically insulating material, for example polyethylene glycol terephthalate, the thickness of which may be, for example, between 0.01 and 0.05 mm. The inner winding 3 is wound onto a tube 7 of, for example, glass fiber reinforced plastics material surrounding the core leg 1. The outer winding 4 is, in turn, wound onto a tube 8 of electrically insulating material surrounding the inner winding 3.

In FIG. 1, the leakage flux passing through the turns of the windings is indicated by dashed lines 9. The end regions of the windings have been shaped so that the foil of the turns 5 and 6 substantially follows the flux lines. Due to this shaping of the turns, the flux does not have any component directed perpendicular to the foil turns so that the formation of eddy currents in the conductor turns is prevented. Thus the current density will be substantially uniform throughout the cross-section of the sheet conductor in each winding.

Figure 2:
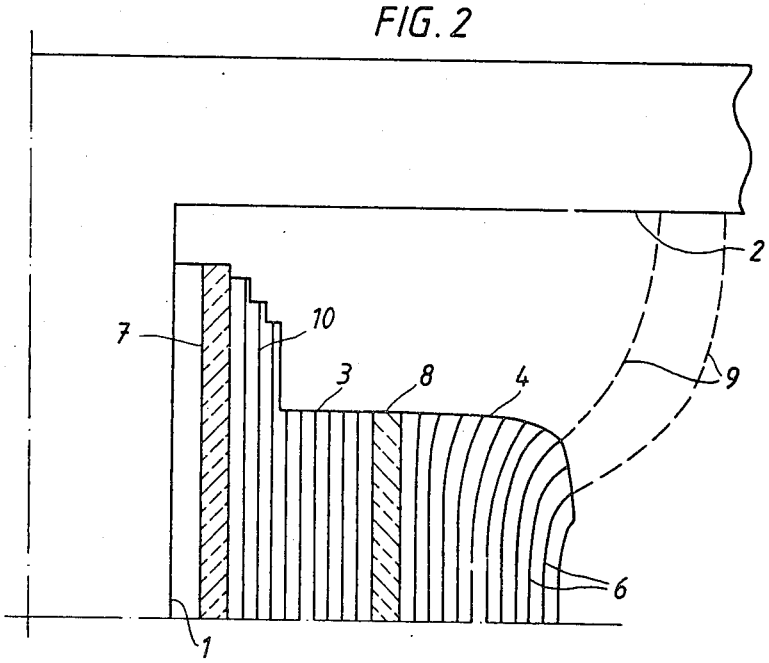
FIG. 2 shows in a corresponding manner an alternative embodiment which is more advantageous from the point of view of manufacture.

In the embodiment shown in FIG. 1, end regions of the early turns of the inner winding 3 are curved inwardly towards the leg 1, but such a construction suffers from the disadvantage of being difficult to produce. A construction which is easier to produce is shown in FIG. 2, in which all turns of the inner winding 3 have a straight cross-section but in which some of the early turns of this winding (i.e. the turns located nearer to the core leg 1) have a greater axial length than the later turns of the inner winding and thus form a cylindrical screen 10 to encourage alignment of the leakage flux with the geometrical axis of the winding in the region close to the core leg (cf. British Patent Specification No. 2,025,148). The later turns 6 of the outer winding 4, on the other hand, in both the embodiments of FIG. 1 and FIG. 2, are shaped so that the edge regions thereof are located at a greater distance from the geometrical axis of the winding compared with the distance from said axis of the respective center regions of those turns, whereby the edge regions of each turn 6 of the outer winding 4 substantially follows the flux lines 9 for the resultant magnetic leakage flux.

Since the space available for the windings in a transformer or reactor core is normally shaped as a circular hollow cylinder, it is desirable for the bent edge portions of the turns of the outer winding 4 to be shaped with a view to utilizing the available winding space to the best advantage (see FIG. 2 where all the early turns of the outer winding have the same axial length). In some cases, however, it may be better to form the outer winding from turns whose axial length decreases with increasing radius substantially throughout the winding (see FIG. 1), which, among other things, has the advantage that the required shaping of the turns results in the elongation of the sheet being maintained at a lower level below the break elongation of the material.

The gaps which arise between the axially outer ends of the turns because of the different curvatures of the conductor sheet in adjacent turns in the radial direction may, for example, be filled with an electrically conducting material. This results in a further reduction of the current density in the critical region at the axial ends of the windings.

Figure 3:
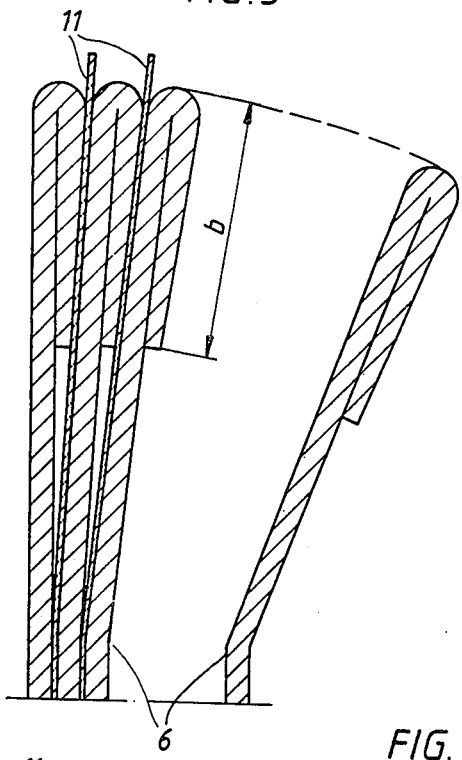
FIGS. 3, 4, 5, 6 and 7 show different solutions for obtaining a funnel-shaped deflection of the outer ends of the winding turns.

FIG. 3 shows an enlarged view of the axial end portions of some of the turns 6 of the outer winding 4 of a further embodiment in which an insulating film 11 is positioned between each winding turn 6. From FIG. 3 it can be seen how the tapering gap between the axial end portions of the turns may be partially filled with conducting material by folding back edge portions of the foil turns 6. By varying the width b of the folded-back portions the shaping of the adjacent turns may be optimized to a certain extent with regard to the configuration of the leakage flux. It is also possible to roll the folded edge portion to reduce the sheet thickness at the edge so that it is less than twice the thickness of the metallic foil.

Figure 4:
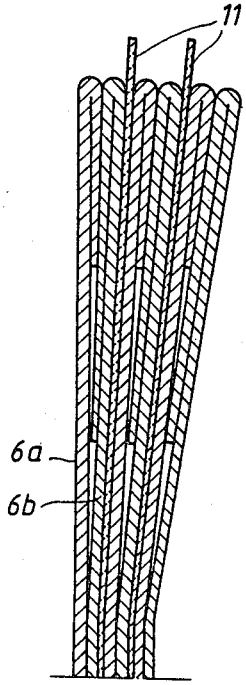

FIG. 4 shows an embodiment in which the turns consist of two parallel foils *6a* and *6b* directly facing each other, each foil having a thickness of half the required conductor turn. Both foils have double-folded edges and the folded portions of the foils face each other and have different widths. In this embodiment, the increase of the sheet thickness in the direction towards the edge takes place in two stages, and this can give rise to a better fill factor.

Figure 5:
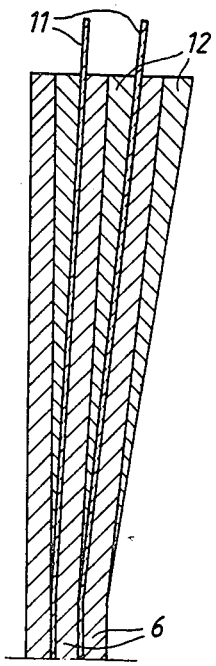

FIG. 5 shows an embodiment in which gaps which would otherwise be available along the axial end of the winding are filled up with turns of an extra foil strip 12 having a wedge-shaped cross-section, the extra foil strip being wound on simultaneously with the conductor foil forming the turns 6. An extra foil strip may, of course, also be used for the embodiments according to FIGS. 3 and 4 to vary the thickness of the sheet edge, such an extra strip then suitably being located inside the folded edge portion.

Figure 6:
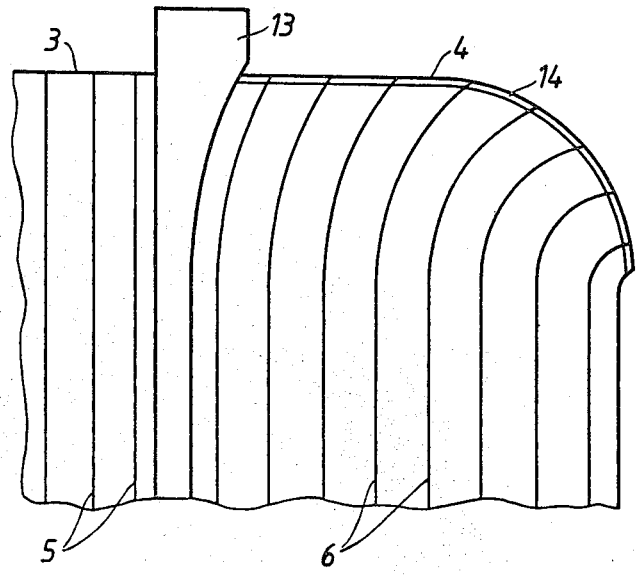

FIG. 6 shows an embodiment in which a spacer 13, located between the inner winding 3 and the outer winding 4, of non-uniform thickness, is employed. The axial end portions of the spacer 13 are shaped so that even the first turn 6 of the outer winding 4 is forced to adopt a curved cross-section in its edge regions. The desired shape of the subsequent turns is obtained by the aid of a gap-filling material in the form of adhesive tape trapped between the winding turns 6 in a relatively narrow edge zone 14.

Figure 7:
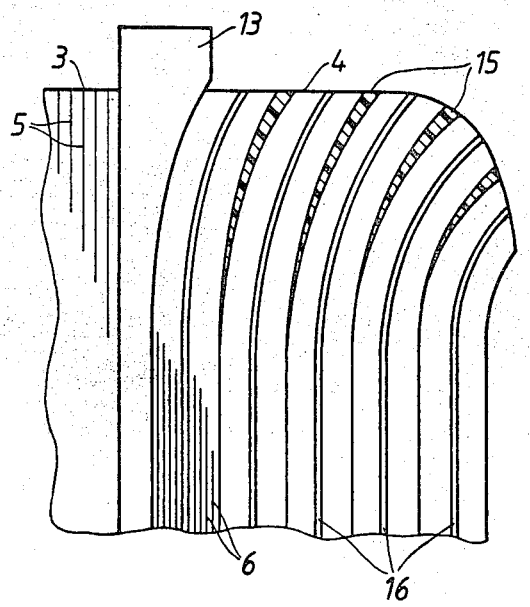

FIG. 7 shows an embodiment in which the gap-filling material consists of an electrically insulating strip 15 having a wedge-shaped cross-section at each axial end of the winding. In this case, as opposed to the embodiment according to FIG. 6, a plurality of turns 6 of the conductor sheet are positioned between adjacent turns of the strips 15, and the gap-filling material extends relatively deeply into the winding. The gap-filling material is shown located approximately mid-way between two adjacent cooling channels 16 (i.e. at a location where the temperature gradient is zero). In this way, thermal conduction in the radial direction of the winding is not affected by the strips 15. Alternatively, the gap-filling material may be applied centrally of the cooling channels. The strips 15 may be fringed so that they need not be stretched when being wound in place.

What is claimed is:

1. A transformer or reactor device comprising a core of magnetic material with at least one leg and one yoke and at least one winding including a plurality of turns of sheet-formed conductor material arranged substantially concentrically around the core leg, said winding further including an inner winding portion and an outer winding portion positioned radially outside the inner winding portion, the conductor sheet in the edge regions of at least the outer turns of the outer winding portion being located at distances from the geometrical axis of the winding which increase successively towards the sheet edge in each respective outer turn, and the cross-sectional bending of the conductor sheet in the edge regions of said outer turns of the outer winding portion increasing with increasing distance from the geometrical axis of the winding in each respective outer turn, and said conductor sheet having a width greater than the entire width of each of said curved edge regions of the winding turns.

2. A transformer or reactor according to claim 1, in which the edge regions of the turns are shaped so that the conductor sheet substantially follows the flux lines for the resultant magnetic leakage flux which correspond to a constant current density in the conductor sheet.

3. A transformer or reactor according to claim 1, in which the axial length of the winding decreases with increasing radius.

4. A transformer or reactor according to claim 1, in which a winding support body is located between the inner and outer winding portions, the radially outer surface of said winding support body being shaped at its end portions to bend the edge regions of the innermost turn of the outer winding portion radially outwardly from said geometrical axis with respect to the central region of said innermost turn.

5. A transformer or reactor according to claim 1, in which gaps made available between edge regions of adjacent turns of the winding by a cross-sectional bending of the conductor sheet in the radial direction are filled with separately applied material.

6. A transformer or reactor according to claim 5, in which the separately applied material is a strip of wedge-shaped cross-section.

7. A transformer or reactor according to claim 5, in which said separately applied material is of electrically insulating material and is located between turns at places in the winding where, in use of the transformer or reactor, the temperature gradient is zero.

8. A transformer or reactor according to claim 1 or claim 2, in which the edge regions of the conductor sheet in at least some turns are folded back on themselves.

9. A transformer or reactor according to claim 8, in which each turn consists of parallel conductor sheets each having edges folded back on themselves, the folded portions of the sheets making up each turn having different widths.

* * * * *